US006254651B1

(12) United States Patent
Brooke et al.

(10) Patent No.: US 6,254,651 B1
(45) Date of Patent: Jul. 3, 2001

(54) MATERIALS FOR USE IN OILS AND PROCESSES FOR THEIR MANUFACTURE

(75) Inventors: Barbara Catherine Brooke, Berkshire; Robert Dryden Tack, Oxfordshire, both of (GB)

(73) Assignee: Exxon Chemical Patents Inc., Linden, NJ (US)

( * ) Notice: Subject to any disclaimer, the term of this patent is extended or adjusted under 35 U.S.C. 154(b) by 0 days.

(21) Appl. No.: 09/202,490

(22) PCT Filed: Jul. 23, 1997

(86) PCT No.: PCT/GB97/01994

§ 371 Date: Dec. 16, 1998

§ 102(e) Date: Dec. 16, 1998

(87) PCT Pub. No.: WO98/03614

PCT Pub. Date: Jan. 29, 1998

(30) Foreign Application Priority Data

Jul. 24, 1996 (GB) ..... 9615497

(51) Int. Cl.[7] ..... C10L 1/18; C10L 1/22
(52) U.S. Cl. ..... 44/405; 44/406
(58) Field of Search ..... 560/169, 170, 560/186; 44/405, 406, 407

(56) References Cited

U.S. PATENT DOCUMENTS

| | | | | |
|---|---|---|---|---|
| 1,475,203 | | 11/1923 | Trolley | 56/15.4 |
| 2,312,082 | * | 2/1943 | Dietrich | 508/476 |
| 3,764,281 | * | 10/1973 | Biasotti | 44/391 |
| 3,961,916 | | 6/1976 | Ilnyckyj et al. | 44/395 |
| 4,211,534 | | 7/1980 | Feldman | 44/394 |
| 4,491,455 | | 1/1985 | Ishizaki et al. | 44/391 |

FOREIGN PATENT DOCUMENTS

| | | |
|---|---|---|
| 0 000061 | 12/1978 | (EP) . |
| 0 117108 | 8/1984 | (EP) . |
| 0 153176 | 8/1985 | (EP) . |
| 0 153177 | 8/1985 | (EP) . |
| 0 225668 | 6/1987 | (EP) . |
| 0 227074 | 7/1987 | (EP) . |
| 0 326356 | 8/1989 | (EP) . |
| 0 327427 | 8/1989 | (EP) . |
| 0 450875 | 10/1994 | (EP) . |
| 2-51477 | 2/1990 | (JP) . |
| 3-34790 | 2/1991 | (JP) . |
| WO 91/11488 | 8/1991 | (WO) . |
| WO 91/16407 | 10/1991 | (WO) . |
| WO 93/04148 | 3/1993 | (WO) . |

* cited by examiner

*Primary Examiner*—Margaret Medley
*Assistant Examiner*—Cephia D. Toomer

(57) ABSTRACT

Reaction products of long chain esters with amines improve the cold flow properties of oils.

31 Claims, No Drawings

MATERIALS FOR USE IN OILS AND PROCESSES FOR THEIR MANUFACTURE

This application is a 371 of PCT/GB97/01994, filed Jul. 23, 1997.

This invention relates to oil compositions, primarily to fuel oil compositions, and more especially to fuel oil compositions susceptible to wax formation at low temperatures, to additives for use with such fuel oil compositions, and to processes for the manufacture of the additives.

Fuel oils, whether derived from petroleum or from vegetable sources, contain components, e.g., alkanes, that at low temperature tend to precipitate as large crystals or spherulites of wax in such a way as to form a gel structure which causes the fuel to lose its ability to flow. The lowest temperature at which the fuel will still flow is known as the pour point.

As the temperature of the fuel falls and approaches the pour point, difficulties arise in transporting the fuel through lines and pumps. Further, the wax crystals tend to plug fuel lines, screens, and filters at temperatures above the pour point. These problems are well recognized in the art, and various additives have been proposed, many of which are in commercial use, for depressing the pour point of fuel oils. Similarly, other additives have been proposed and are in commercial use for reducing the size and changing the shape of the wax crystals that do form. Smaller size crystals are desirable since they are less likely to clog a filter. The wax from a diesel fuel, which is primarily an alkane wax, crystallizes as platelets; certain additives inhibit this and cause the wax to adopt an acicular habit, the resulting needles being more likely to pass through a filter than are platelets. The additives may also have the effect of retaining in suspension in the fuel the crystals that have formed, the resulting reduced settling also assisting in prevention of blockages.

Effective wax crystal modification (as measured by cold filter plugging point (CFPP) and other operability tests, as well as simulated and field performance) is achieved by ethylene-vinyl acetate (EVAC) or propionate copolymer-based flow improvers.

The present invention provides the use, to improve cold flow characteristics of an oil, of a compound of the formula $$(R^1R^2N)m—A—(NR^4R^3)_n \qquad Ia$$

or $$BNR^1{}_2 \qquad Ib$$

wherein

A represents an (m+n) valent and B represents a monovalent hydrocarbon radical optionally interrupted by at least one heteroatom selected from oxygen and nitrogen, each $R^1$ independently represents $$—CHR^4(CHR^5)_pCOOR^6 \qquad II$$

$R^2$ and $R^3$ each independently represent $R^1$, H, or an alkyl group containing from 1 to 8 carbon atoms, $R^4$ and $R^5$ each independently represent H or an alkyl group containing from 1 to 8 carbon atoms, each $R^6$ independently represents a hydrocarbyl group, at least one $R^6$ containing from 8 to 32 carbon atoms optionally interrupted by at least one hetero atom selected from oxygen and nitrogen, m and n each represent an integer up to 12 or zero provided that the total number of $R^1$ groups is at least 2, and p represents zero or an integer of 1 to 4.

As used in this specification the term "hydrocarbon" and related terms refer to a group having a hydrocarbon or predominantly hydrocarbon character. Among these, there may be mentioned hydrocarbon groups, including aliphatic (e.g., alkyl), alicyclic (e.g., cycloalkyl), aromatic, aliphatic- and alicyclic-substituted aromatic, and aromatic-substituted aliphatic and alicyclic groups. Aliphatic groups are advantageously saturated. These groups may contain non-hydrocarbon substituents provided their presence does not alter the predominantly hydrocarbon character of the group. Examples include keto, halo, hydroxy, nitro, cyano, alkoxy and acyl. As indicated above, the groups may also or alternatively contain atoms other than carbon in a chain or ring otherwise composed of carbon atoms. Advantageously, except in relation to the oxygen- and nitrogen-interrupted chains represented by A and B and exemplified below, in such an interrupted chain or ring, the carbon:heteroatom ratio is at least 6:1, and is preferably at least 10:1. Advantageously, the hydrocarbon group is linked to the other part or parts of the molecule through a carbon atom.

Advantageously, the hydrocarbon radical represented by A or B has from 1 to 200 carbon atoms, preferably from 2 to 65 carbons, and advantageously from 2 to 60. Preferably, if the hydrocarbon radical is divalent, and uninterrupted, e.g., an alkylene radical, it has up to 16 carbon atoms. If it is interrupted, e.g,. by oxygen atoms, it preferably has from 4 to 60 carbon atoms. Advantageously the radical is a saturated aliphatic radical. Saturated aliphatic radicals may be derived from, for example, ethane, butane, methylene-bis(cyclohexyl), or hexane. Alternatively the radical is an aromatic radical, advantageously one having aliphatic substituents, e.g., one derived from xylene, especially m-xylene, each of the free valencies being attached to a methyl carbon atom.

Examples of hydrocarbons interrupted by nitrogen atoms include 3-azapentane, 3-(2-aminoethyl) azapentane, 3,5-azaoctane, and 3,5,8-azaundecane.

Examples of hydrocarbon radicals interrupted by oxygen atoms include polyoxyalkylene, especially polyoxyethylene and/or propylene, radicals, e.g., those of the formula $$—[CH(CH_3)CH_2O]_a—[CH_2CH_2O]_b—[CH_2CH(CH_3)O]_c—CH_2CH(CH_3)—, \qquad VII$$

where a+c is advantageously within the range of 2 to 4 and b is advantageously within the range of 5 to 100, and of the formulae $$\begin{array}{l} \quad CH_2—(OCH_2CH(CH_3))_x— \\ HC\!\!\leftarrow\!\!CH_2—(OCH_2CH(CH_3))_y— \\ \quad CH_2—(OCH_2CH(CH_3))_z— \end{array} \qquad VIII$$

or $$\begin{array}{l} CH_2—CH_2—(OCH_2CH(CH_3))_x— \\ | \\ CH—CH_2—(OCH_2CH(CH_3))_y— \\ | \\ CH_2—CH_2—(OCH_2CH(CH_3))_z— \end{array} \qquad IX$$

where x+y+z is advantageously within the range of 3 to 100.

Advantageously, $R^4$ represents hydrogen, and $R^5$ advantageously represents hydrogen or methyl. Preferably $R^4$ and $R^5$ both represent hydrogen.

Advantageously, the hydrocarbyl radical represented by $R^6$ has from 8 to 32, preferably from 18 to 30, carbon atoms. Advantageously the radical is a saturated aliphatic radical.

The radical is preferably a linear alkyl group, or a lightly branched, preferably methyl branched, group, the branch advantageously being near the free end of the chain. The radical may be interrupted by one or more oxygen atoms and, if so interrupted, is advantageously a polyoxyalkylene radical or a polyoxyalkylene-substituted alkyl radical. The radical may be interrupted by one or more nitrogen atoms, and if so interrupted may carry an amino substituent.

The sum of m+n is advantageously such that the total number of $R^1$ groups is from 2 to 12, preferably from 2 to 6. It will be appreciated from the discussion below of processes for the manufacture of the compounds that, depending inter alia on the proportions and nature of the reactants and the reaction conditions, the number of $R^2$ and $R^3$ groups that are substituents of the formula II (i.e., are represented by $R^1$) may vary, and that mixtures of compounds in which some groups $R^2$ and $R^3$ represent $R^1$ and others represent hydrogen or an alkyl group may result. It may be advantageous to use a mixture of reactants, e.g., those providing the radicals A and $R^6$. Further, since A may represent a radical that is interrupted by nitrogen, the compound may contain additional primary or secondary amine groups. Advantageously, all $R^2$ and $R^3$ groups represent $R^1$.

The compounds may be manufactured by a number of different processes.

For example, a compound in which p=1 may be made by the esterification of an α, β-olefinically unsaturated carboxylic acid by a long chain hydroxy compound under esterification conditions that retain the olefinic bond, followed by Michael-type addition of an appropriate polyamine across the double bond. In EP-A0450875, the disclosure of which is incorporated by reference herein, this procedure is refined using a low molecular weight hydroxy compound and subsequently transesterifying with the desired long chain hydroxy compound.

As the unsaturated acid there may be mentioned, more especially, acrylic or methacrylic acid.

As the long chain hydroxy compound, an alkanol, or mixture of alkanols, may be mentioned. The alkanols may be straight or branched chain alkanols, e.g., those containing from 18 to 30 carbon atoms, more especially octadecyl, icosyl and docosyl alcohols or mixtures thereof.

As the amine, there may be mentioned butylamine, ethylene diamine, trisaminoethyl amine diethylene triamine and polyoxyalkylene di- and tri-amines resulting from attaching primary amine groups to the free valencies of radicals of the formula VII, VIII, and IX above, commercially available as Jeffamines (trademark).

A compound in which p=0 may be made by reaction of a haloacetic acid ester with a polyamine, using the procedure described, for example, in EP-A-227074, the disclosure of which is incorporated herein by reference.

EP-A-227074 describes aminocarboxylic acid-terminated polyoxyalkylenes for use as extreme pressure functional fluids, e.g., for use as or in cutting fluids or lubricating oils. These acids are the acids corresponding to the esters of the present invention in which p=0. EP-A-450875 describes diesters similar to those of the present invention, in which p=1, for use as lubricating or fuel oil additives, the purpose exemplified being to reduce valve deposits in a gasoline-burning engine.

Some compounds mentioned in EP-A-450875 are within the ambit of Formula I*a* in which the total of $R^1$ groups is 2, these compounds including the Michael-type adduct of N,N-dimethylaminopropylamine and the acrylate ester of the reaction product of 1 mole of p-dodecylphenol and 11 moles of propylene oxide.

Certain of the compounds of Formula I*a* are new, however, and accordingly the present invention also provides a compound of the formula $$(R^1R^2N)_m—A—(NR^1R^3)_n \qquad Ic$$

wherein

A represents an (m+n) valent hydrocarbon radical optionally interrupted by at least one heteroatom selected from oxygen and nitrogen, each $R^1$ independently represents $$—CHR^4(CHR^5)_pCOOR^6 \qquad II$$

$R^2$ and $R^3$ each independently represent $R^1$, H, or an alkyl group containing from 1 to 8 carbon atoms, $R^4$ and $R^5$ each independently represent H or an alkyl group containing from 1 to 8 carbon atoms, $R^6$ represents a hydrocarbyl group containing from 8 to 32 carbon atoms optionally interrupted by at least one hetero atom selected from oxygen and nitrogen, m and n each represent an integer up to 12 or zero, and p represents 0 or an integer within the range of 1 to 4, provided that the total number of $R^1$ groups is at least 3 when p represents 1 and is at least 2 when p represents 0.

The invention also provides a composition comprising an oil and a compound of the Formula I*c*.

The invention further provides an additive concentrate containing a compound of the Formula I*c* in admixture with an oil or a solvent miscible with oil.

The invention further provides a process for the manufacture of a compound of the Formula I*a* or I*b* in which p represents 1, which comprises treating a compound of the formula $$(R^4R^5N)_m—A—(NR^4R^5)_n \text{ or } BNR^4R^5 \qquad III$$

with a compound of the formula $$CHR^4{=}CR^5COOR^6 \qquad IV$$

wherein A, B, $R^4$, $R^5$, $R^6$, m and n have the meanings given above, under Michael-type addition conditions, the relative proportions of the compounds of formulae III and IV being such that a compound of the formula I*a* or I*b* results, or with a compound of the formula $$CHR^4{=}CR^5COOR^9 \qquad V$$

in which $R^4$ and $R^5$ have the meanings given above and $R^9$ represents a hydrocarbyl radical exchangeable by transesterification with a radical $R^6$ as defined above, and transesterifying the product with a compound of the formula $$R^6OH \qquad VI$$

under conditions such that a compound of the formula I*a* or I*b* results.

The invention further provides a process for the manufacture of a compound of the formula I*a* and I*b* in which p represents 0, which comprises treating a compound of the formula III with an α-halocarboxylic acid, or an amide or ester thereof, in the presence of a base and, if an acid, or an ester other than one in which the alcohol moiety is derivable from a compound of the formula IV, is used, esterifying or transesterifying the resulting product with a compound of the formula VI.

In the oil-containing compositions of the invention, the oil may be a crude oil, i.e. oil obtained directly from drilling and before refining.

The oil may be a lubricating oil, which may be an animal, vegetable or mineral oil, such, for example, as petroleum oil fractions ranging from naphthas or spindle oil to SAE 30, 40 or 50 lubricating oil grades, castor oil, fish oils or oxidized mineral oil. Such an oil may contain additives depending on its intended use; examples are viscosity index improvers such as ethylene-propylene copolymers, succinic acid based dispersants, metal containing dispersant additives and zinc dialkyl-dithiophosphate antiwear additives. The compounds of this invention may be suitable for use in lubricating oils as a flow improver, pour point depressant or dewaxing aid.

The oil may be a fuel oil, e.g., a petroleum-based fuel oil, especially a middle distillate fuel oil. Such distillate fuel oils generally boil within the range of from 110° C. to 500° C., e.g. 150° to 400° C. The fuel oil may comprise atmospheric distillate or vacuum distillate, cracked gas oil, or a blend in any proportion of straight run and thermally and/or catalytically cracked distillates. The most common petroleum distillate fuels are kerosene, jet fuels, diesel fuels, heating oils and heavy fuel oils. The heating oil may be a straight atmospheric distillate, or it may contain minor amounts, e.g. up to 35 wt %, of vacuum gas oil or cracked gas oil or of both. The above-mentioned low temperature flow problem is most usually encountered with diesel fuels and with heating oils. The invention is also applicable to vegetable-based fuel oils, for example rape seed oil, used alone or in admixture with a petroleum distillate oil.

The compounds of the invention are especially useful in fuel oils having a relatively high wax content, e.g., a wax content above 2%, especially above 3%, and more especially above 4%, by weight at 10° C. below cloud point.

The compounds should preferably be soluble in the oil to the extent of at least 1000 ppm by weight per weight of oil at ambient temperature. However, at least some of the compound may come out of solution near the cloud point of the oil and function to modify the wax crystals that form.

The additive concentrate and the oil composition may contain other additives for improving low temperature and/or other properties, many of which are in use in the art or known from the literature.

For example, the composition may also contain (A) an ethylene-unsaturated ester, especially a vinyl ester, copolymer. As disclosed in U.S. Pat. No. 3,961,916, flow improver compositions may comprise a wax growth arrestor and a nucleating agent. Without wishing to be bound by any theory, the applicants believe that a compound of the invention acts primarily as a nucleator and will benefit from the presence of an arrestor which may, for example, be an ethylene-unsaturated ester, especially vinyl acetate, copolymer with a molecular weight of at most 14000, advantageously at most 10000, preferably 3000 to 6000, and more preferably from 3500 to 5500, and an ester content of 7.5% to 35%, preferably from 10 to 20, and more preferably from 10 to 17, molar percent.

The composition may also comprise additional cold flow improvers, including (B) a comb polymer.

Such polymers are polymers in which branches containing hydrocarbyl groups are pendant from a polymer backbone, and are discussed in "Comb-Like Polymers. Structure and Properties", N. A. Plate and V. P. Shibaev, J. Poly. Sci. Macromolecular Revs., 8, p 117 to 253 (1974).

Generally, comb polymers have one or more long chain hydrocarbyl branches, e.g., oxyhydrocarbyl branches, normally having from 10 to 30 carbon atoms, pendant from a polymer backbone, said branches being bonded directly or indirectly to the backbone. Examples of indirect bonding include bonding via interposed atoms or groups, which bonding can include covalent and/or electrovalent bonding such as in a salt.

Advantageously, the comb polymer is a homopolymer having, or a copolymer at least 25 and preferably at least 40, more preferably at least 50, molar per cent of the units of which have, side chains containing at least 6, and preferably at least 10, atoms.

As examples of preferred comb polymers there may be mentioned those of the general formula

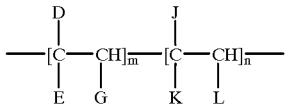

wherein

D=$R^{11}$, $COOR^{11}$, $OCOR^{11}$, $R^{12}COOR^{11}$, or $OR^{11}$,

E=H, $CH_3$, D, or $R^{12}$,

G=H or D

J=H, $R^{12}$, $R^{12}COOR^{11}$, or an aryl or heterocyclic group,

K=H, $COOR^{12}$, $OCOR^{12}$, $OR^{12}$, or COOH,

L=H, $R^{12}$, $COOR^{12}$, $OCOR^{12}$, COOH, or aryl, $R^{11} \geqq C_{10}$ hydrocarbyl, $R^{12} \geqq C_1$ hydrocarbyl or hydrocarbylene, and m and n represent mole fractions, m being finite and preferably within the range of from 1.0 to 0.4, n being less than 1 and preferably in the range of from 0 to 0.6. $R^{11}$ advantageously represents a hydrocarbyl group with from 10 to 30 carbon atoms, while $R^{12}$ advantageously represents a hydrocarbyl or hydrocarbylene group with from 1 to 30 carbon atoms.

The comb polymer may contain units derived from other monomers if desired or required.

These comb polymers may be copolymers of maleic anhydride or fumaric or itaconic acids and another ethylenically unsaturated monomer, e.g., an α-olefin, including styrene, or an unsaturated ester, for example, vinyl acetate or homopolymers of fumaric or itaconic acids. It is preferred but not essential that equimolar amounts of the comonomers be used although molar proportions in the range of 2 to 1 and 1 to 2 are suitable. Examples of olefins that may be copolymerized with e.g., maleic anhydride, include 1-decene, 1-dodecene, 1-tetradecene, 1-hexadecene, and 1-octadecene.

The acid or anhydride group of the comb polymer may be esterified by any suitable technique and although preferred it is not essential that the maleic anhydride or fumaric acid be at least 50% esterified. Examples of alcohols which may be used include n-decan-1-ol, n-dodecan-1-ol, n-tetradecan-1-ol, n-hexadecan-1-ol, and n-octadecan-1-ol. The alcohols may also include up to one methyl branch per chain, for example, 1-methylpentadecan-1-ol or 2-methyltridecan-1-ol. The alcohol may be a mixture of normal and single methyl branched alcohols. It is preferred to use pure alcohols rather than the commercially available alcohol mixtures but if mixtures are used the $R^{12}$ refers to the average number of carbon atoms in the alkyl group; if alcohols that contain a branch at the 1 or 2 positions are used $R^{12}$ refers to the straight chain backbone segment of the alcohol.

These comb polymers may especially be fumarate or itaconate polymers and copolymers such for example as those described in EP-A-153176, -153177, and -225688, and WO 91/16407.

Particularly preferred fumarate comb polymers are copolymers of alkyl fumarates and vinyl acetate, in which the alkyl groups have from 12 to 20 carbon atoms, more especially polymers in which the alkyl groups have 14 carbon atoms or in which the alkyl groups are a mixture of $C_{14}/C_{16}$ alkyl groups, made, for example, by solution copolymerizing an equimolar mixture of fumaric acid and vinyl acetate and reacting the resulting copolymer with the alcohol or mixture of alcohols, which are preferably straight chain alcohols. When the mixture is used it is advantageously a 1:1 by weight mixture of normal $C_{14}$ and $C_{16}$ alcohols. Furthermore, mixtures of the $C_{14}$ ester with the mixed $C_{14}/C_{16}$ ester may advantageously be used. In such mixtures, the ratio of $C_{14}$ to $C_{14}/C_{16}$ is advantageously in the range of from 1:1 to 4:1, preferably 2:1 to 7:2, and most preferably about 3:1, by weight. The particularly preferred comb polymers are those having a number average molecular weight, as measured by vapour phase osmometry, of 1,000 to 100,000, more especially 1,000 to 30,000.

Further suitable comb polymers are polymers of alkyl acrylates or methacrylates, the alkyl groups of which have advantageously have 10 or more carbon atoms, preferably an average of 10 to 18, more preferably 12 to 18, and most preferably 12 to 16 carbon atoms. Advantageously, the alkyl groups are n-alkyl groups, n-alkyl groups containing an average of 12 to 14 carbon atoms being preferred. Copolymers of the above alkyl acrylate and methacrylates may also be employed.

Other suitable comb polymers are the polymers and copolymers of α-olefins and esterified copolymers of styrene and maleic anhydride, and esterified copolymers of styrene and fumaric acid; mixtures of two or more comb polymers may be used in accordance with the invention and, as indicated above, such use may be advantageous. Other examples of comb polymers are hydrocarbon polymers, e.g., copolymers of ethylene and at least one α-olefin, the α-olefin preferably having at most 20 carbon atoms, examples being n-decene-1 and n-dodecene-1. Preferably, the number average molecular weight of such a copolymer is at least 30,000 measured by gel permeation chromatography (GPC). The hydrocarbon copolymers may be prepared by methods known in the art, for example using a Ziegler type catalyst.

Other additives for improving low temperature properties are:

(C) Polar Nitrogen Compounds.

Such compounds are oil-soluble polar nitrogen compounds carrying one or more, preferably two or more, substituents of the formula $>NR^{13}$, where $R^{13}$ represents a hydrocarbyl group containing 8 to 40 atoms, which substituent or one or more of which substituents may be in the form of a cation derived therefrom. The oil-soluble polar nitrogen compound is generally one capable of acting as a wax crystal growth inhibitor in fuels. It comprises for example one or more of the following compounds:

An amine salt and/or amide formed by reacting at least one molar proportion of a hydrocarbyl-substituted amine with a molar proportion of a hydrocarbyl acid having from 1 to 4 carboxylic acid groups or its anhydride, the substituent (s) of formula $>NR^{13}$ being of the formula $—NR^{13}R^{14}$ where $R^{13}$ is defined as above and $R^{14}$ represents hydrogen or $R^{13}$, provided that $R^{13}$ and $R^{14}$ may be the same or different, said substituents constituting part of the amine salt and/or amide groups of the compound.

Ester/amides may be used, containing 30 to 300, preferably 50 to 150, total carbon atoms. These nitrogen compounds are described in U.S. Pat. No. 4,211,534. Suitable amines are predominantly $C_{12}$ to $C_{40}$ primary, secondary, tertiary or quaternary amines or mixtures thereof but shorter chain amines may be used provided the resulting nitrogen compound is oil soluble, normally containing about 30 to 300 total carbon atoms. The nitrogen compound preferably contains at least one straight chain $C_8$ to $C_{40}$, preferably $C_{14}$ to $C_{24}$, alkyl segment.

Suitable amines include primary, secondary, tertiary or quaternary, but are preferably secondary. Tertiary and quaternary amines only form amine salts. Examples of amines include tetradecylamine, cocoamine, and hydrogenated tallow amine. Examples of secondary amines include dioctacedyl amine and methylbehenyl amine. Amine mixtures are also suitable such as those derived from natural materials. A preferred amine is a secondary hydrogenated tallow amine, the alkyl groups of which are derived from hydrogenated tallow fat composed of approximately 4% $C_{14}$, 31% $C_{16}$, and 59% $C_{18}$.

Examples of suitable carboxylic acids and their anhydrides for preparing the nitrogen compounds include ethylenediamine tetraacetic and nitriloacetic acids, and carboxylic acids based on cyclic skeletons, e.g., cyclohexane-l,2-dicarboxylic acid, cyclohexene-1,2-dicarboxylic acid, cyclopentane-1,2-dicarboxylic acid and naphthalene dicarboxylic acid, and 1,4-dicarboxylic acids including dialkyl spirobislactones. Generally, these acids have about 5 to 13 carbon atoms in the cyclic moiety. Preferred acids useful in the present invention are benzene dicarboxylic acids e.g., phthalic acid, isophthalic acid, and terephthalic acid. Phthalic acid and its anhydride are particularly preferred. The particularly preferred compound is the amide-amine salt formed by reacting 1 molar portion of phthalic anhydride with 2 molar portions of di-hydrogenated tallow amine. Another preferred compound is the diamide formed by dehydrating this amide-amine salt.

Other examples are long chain alkyl or alkylene substituted dicarboxylic acid derivatives such as amine salts of monoamides of substituted succinic acids, examples of which are known in the art and described in U.S. Pat. No. 4,147,520, for example. Suitable amines may be those described above.

Other examples are condensates, for example, those described in EP-A-327427.

(D) A Compound Containing a Cyclic Ring System Carrying at Least Two Substituents of the General Formula Below on the Ring System $$—A—NR^{15}R^{16}$$

where A is a linear or branched chain aliphatic hydrocarbylene group optionally interrupted by one or more hetero atoms, and $R^{15}$ and $R^{16}$ are the same or different and each is independently a hydrocarbyl group containing 9 to 40 atoms optionally interrupted by one or more hetero atoms, the substituents being the same or different and the compound optionally being in the form of a salt thereof. Advantageously, A has from 1 to 20 carbon atoms and is preferably a methylene or poly-methylene group. Such compounds are described in WO 93/04148.

(E) A Hydrocarbon Polymer.

Examples of suitable hydrocarbon polymers are those of the general formula

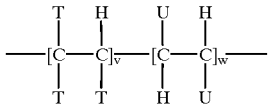

wherein

T=H or $R^{21}$, wherein $R^{21}=C_1$ to $C_{40}$ hydrocarbyl, and

U=H, T, or aryl and v and w represent mole fractions, v being within the range of from 1.0 to 0.0, w being in the range of from 0.0 to 1.0.

The hydrocarbon polymers may be made directly from monoethylenically unsaturated monomers or indirectly by hydrogenating polymers from polyunsaturated monomers, e.g., isoprene and butadiene.

Examples of hydrocarbon polymers are disclosed in WO 91/11488.

Preferred copolymers are ethylene α-olefin copolymers, having a number average molecular weight of at least 30,000. Preferably the α-olefin has at most 28 carbon atoms. Examples of such olefins are propylene, 1-butene, isobutene, n-octene-1, isooctene-1, n-decene-l, and n-dodecene-1. The copolymer may also comprise small amounts, e.g, up to 10% by weight, of other copolymerizable monomers, for example olefins other than α-olefins, and non-conjugated dienes. The preferred copolymer is an ethylene-propylene copolymer.

The number average molecular weight of the ethylene-α-olefin copolymer is, as indicated above, preferably at least 30,000, as measured by GPC relative to polystyrene standards, advantageously at least 60,000 and preferably at least 80,000. Functionally no upper limit arises but difficulties of mixing result from increased viscosity at molecular weights above about 150,000, and preferred molecular weight ranges are from 60,000 and 80,000 to 120,000.

Advantageously, the copolymer has a molar ethylene content between 50 and 85 per cent. More advantageously, the ethylene content is within the range of from 57 to 80%, and preferably it is in the range from 58 to 73%; more preferably from 62 to 71%, and most preferably 65 to 70%.

Preferred ethylene-α-olefin copolymers are ethylene-propylene copolymers with an ethylene content of from 62 to 71% and a number average molecular weight in the range 60,000 to 120,000; especially preferred copolymers are ethylene-propylene copolymers with an ethylene content of from 62 to 71% and a molecular weight from 80,000 to 100,000.

The copolymers may be prepared by any of the methods known in the art, for example using a Ziegler type catalyst. The polymers should be substantially amorphous, since highly crystalline polymers are relatively insoluble in fuel oil at low temperatures.

Other suitable hydrocarbon polymers include a low molecular weight ethylene-C-olefin copolymer, advantageously with a number average molecular weight of at most 7500, advantageously from 1,000 to 6,000, and preferably from 2,000 to 5,000, as measured by vapour phase osmometry. Appropriate α-olefins are as given above, or styrene, with propylene again being preferred. Advantageously the ethylene content is from 60 to 77 molar per cent, although for ethylene-propylene copolymers up to 86 molar per cent by weight ethylene may be employed with advantage.

(F) A polyoxyalkylene compound. Examples are polyoxyalkylene esters, ethers, ester/ethers and mixtures thereof, particularly those containing at least one, preferably at least two, $C_{10}$ to $C_{30}$ linear alkyl groups and a polyoxyalkylene glycol group of molecular weight up to 5,000, preferably 200 to 5,000, the alkyl group in said polyoxyalkylene glycol containing from 1 to 4 carbon atoms. These materials form the subject of EP-A-0 061 895. Other such additives are described in U.S. Pat. No. 4,491,455.

The preferred esters, ethers or ester/ethers are those of the general formula $$R^{31}—O(D)—O—R^{32}$$

where $R^{31}$ and $R^{32}$ may be the same or different and represent (a) n—alkyl—

(b) n—alkyl—CO—

(c) n—alkyl—O—$CO(CH_2)_x$— or (d) n—alkyl—O—$CO(CH_2)$x—CO— x being, for example, 1 to 30, the alkyl group being linear and containing from 10 to 30 carbon atoms, and D representing the polyalkylene segment of the glycol in which the alkylene group has 1 to 4 carbon atoms, such as a polyoxymethylene, polyoxyethylene or polyoxytrimethylene moiety which is substantially linear; some degree of branching with lower alkyl side chains (such as in polyoxypropylene glycol) may be present but it is preferred that the glycol is substantially linear. D may also contain nitrogen.

Examples of suitable glycols are substantially linear polyethylene glycols (PEG) and polypropylene glycols (PPG) having a molecular weight of from 100 to 5,000, preferably from 200 to 2,000. Esters are preferred and fatty acids containing from 10–30 carbon atoms are useful for reacting with the glycols to form the ester additives, it being preferred to use a $C_{18}$–$C_{24}$ fatty acid, especially behenic acid. The esters may also be prepared by esterifying polyethoxylated fatty acids or polyethoxylated alcohols.

Polyoxyalkylene diesters, diethers, ether/esters and mixtures thereof are suitable as additives, diesters being preferred for use in narrow boiling distillates, when minor amounts of monoethers and monoesters (which are often formed in the manufacturing process) may also be present. It is preferred that a major amount of the dialkyl compound be present. In particular, stearic or behenic diesters of polyethylene glycol, polypropylene glycol or polyethylene/polypropylene glycol mixtures are preferred.

Other examples of polyoxyalkylene compounds are those described in Japanese Patent Publication Nos. 2-51477 and 3-34790, and the esterified alkoxylated amines described in EP-A-117,108 and EP-A-326,356.

It is within the scope of the invention to use two or more additional flow improvers advantageously selected from one or more of the different classes outlined above.

The additional flow improver is advantageously employed in a proportion within the range of from 0.01% to 1%, advantageously 0.05% to 0.5%, and preferably from 0.075 to 0.25%, by weight, based on the weight of fuel.

The flow improver of the invention may also be used in combination with one or more other co-additives such as known in the art, for example the following: detergents, particulate emission reducers, storage stabilizers, antioxidants, corrosion inhibitors, dehazers, demulsifiers, antifoaming agents, cetane improvers, cosolvents, package compatibilizers, and lubricity additives.

The fuel oil composition of the invention advantageously contains a compound of the invention in a proportion of 0.0005% to 1%, advantageously 0.001 to 0.1%, and preferably 0.02 to 0.06% by weight, based on the weight of fuel.

Additive concentrates according to the invention advantageously contain between 3 and 75%, preferably between 10 and 65%, of the compound in an oil or a solvent miscible with oil.

The following Examples, in which all parts and percentages are by weight, illustrate the invention.

EXAMPLES 1 to 29

Preparation of Compounds

Example 1

To 6 g of Jeffamine ED-600, a compound in which A is of the Formula VII, in which b is about 8.5 and a+c about 2.5, terminated at each end by NH2 groups, and having a molecular weight about 600, 3.52 g icosyl acrylate, and 5.52 docosyl acrylate, the latter with small amounts of esters of higher alcohols, were added 200 microliters of a 10% methylbutylhydroquinone solution in iso-propyl alcohol as a polymerization inhibitor. The reaction vessel was placed in an 80° C. oven overnight. HNMR showed the disappearance of the acrylate peak and the movement of the amine peak, confirming Michael-type addition, forming a product $$(C_{20}+C_{22})OOCCH_2CH_2NH\text{—polyakylene oxide—}NH\text{—}CH_2\text{—}CH_2\text{—}COO(C_{20}+C_{22})$$

It will be understood that the product is likely to be a mixture primarily of three species, the di-$C_{20}$ ester, the di-$C_{22}$ ester, and the mixed $C_{20}/C_{22}$ ester, and small proportions of esters and mixed esters of the higher alcohols.

Example 2

To 7.54 g of Jeffamine 600 in a 3 necked flask, fitted with a nitrogen sparge, in an oil bath were added 20 g (3.5 equivalent) of a mixed acrylate containing 17%, 39%, and 44% by weight of octadecyl, icosyl and docosyl radicals respectively. The oil bath was heated to 120° C. and maintained at that temperature for 5 hours. Approximately 60% of the acrylate reacted (as shown by NMR), confirming a product similar to that of Example 1 was produced.

Example 3

The procedure of Example 1 was repeated, but using 9 g of Jeffamine ED-900, a compound in which A is of the formula VII in which b is about 15.5 and a+c about 2.5, and molecular weight about 900.

Example 4

The procedure of Example 2 was repeated, but using 19.8 g of Jeffamine ED-900, and 20 g (2.0 equivalents) of the mixed acrylate used in Example 2.

Example 5

The procedure of Example 1 was repeated using 20 g of Jeffamine ED-2000, a compound in which A is of the formula VII in which b is about 40.5, a+c about 2.5, and molecular weight about 2000.

Example 6

To make a product in which the amino groups of the Jeffamine have each linked across the olefinic double bonds of two acrylic groups, 5 g of the product of Example 1 were treated with 2.67 g of $C_{20}$ acrylate and 3.36 g of $C_{22}$ acrylate, together with a further 200 microliters of the inhibitor solution. The reaction vessel was maintained at 80° C. for 6 days.

Example 7

5 g of the product of Example 3 were treated by the procedure of Example 6, but using 2.89 g of $C_{20}$ acrylate and 3.64 g $C_{22}$ acrylate.

Example 8

5 g of the product of Example 5 were treated by the procedure of Example 6, but using 3.31 g $C_{20}$ acrylate and 4.17 g $C_{22}$ acrylate.

Example 9

To a three necked flask, equipped with a condenser, in an oil bath were added 4.76 g Jeffamine T403, in which the triol is of Formula VIII, x+y+z, 4 to 6, 20 g (4 equivalents) of the mixed acrylates used in Example 2, about 30 ml of t-butanol and a spatula measure of a molecular sieve. The oil bath was heated to 80° C. and maintained at that temperature for 15 hours, after which time 90% of the acrylate had reacted.

Example 10

The procedure of Example 2 was repeated, but using 1.6 g of hexanediamine and 20 g (3.5 equivalent) of the mixed acrylate used in Example 2.

Examples 11 to 17

The procedure of Example 2 was repeated, but using m-xylylenediamine and different alkyl acrylates, as shown in Table 1 below.

TABLE 1

| Example | Acrylate | Molar Ratio amine:acrylate |
|---|---|---|
| 11 | $C_{12}$ | 1:3 |
| 12 | $C_{14}$ | 1:3 |
| 13 | $C_{16}$ | 1:3 |
| 14 | $C_{18}$ | 1:3 |
| 15 | $C_{20}/C_{22}$ | 1:3 |
| 16 | $C_{22}$ to $C_{28}$ | 1:3 |
| 17 | mixed (as in Ex. 2) | 1:3.6 |

Examples 18 to 29

The procedures of various Examples above were repeated, but using different starting materials and molar ratios and in some cases different temperatures and or times, as shown in Table 2 below. In Example 24, reaction was carried out for 12 hours in a three necked flask equipped with a condenser in an oil bath maintained at 100° C.

TABLE 2

| Example | Amine | Acrylate | Molar Ratio Amine:Acrylate | Reaction Conditions |
|---|---|---|---|---|
| 18 | $C_{18}$ | $C_{20}$ | 1:2 | As Ex. 1, but 4 hrs, 80° C./$N_2$ |
| 19 | T2AEA | $C_{20/22}$ | 1:5 | As Ex. 1 |
| 20 | Jeffamine T | As Ex. 2 | 1:5 | As Ex. 9 |
| 21 | Jeffamine 600 | As Ex. 2 | 1:3.5 | As Ex. 9 |
| 22 | m-xylylene diamine | As Ex. 2 | 1:3.6 | As Ex. 2, but 2 hrs |
| 23 | TEPA | As Ex. 2 | 1:5 | As Ex. 9, but 20 hrs |
| 24 | MBCA | As Ex. 2 | 1:3.5 | See Above |
| 25 | 1,6-hexanediamine | As Ex. 2 | 1:3.6 | As Ex. 2, but 6 hrs. |
| 26 | T2AEA | As Ex. 2 | 1:5 | As Ex. 1 |
| 27 | T2AEA | As Ex. 2 | 1:5 | As Ex. 1, but 6 hrs, 90° C. |
| 28 | Tetramine | As Ex. 2 | 1:6 | As Ex. 9 |
| 29 | 1,6-hexanediamine | As Ex. 2 | 1:3.5 | As Ex. 2, 6 hrs. |

Glossary

T2AEA : Tris(2-aminoethyl)amine

TEPA : Tetraethylenepentamine

MBCA : 4,4'-methylenebis(cyclohexylamine)

Tetramine : $(H_2NCH_2CH_2CH_2)_2NCH_2CH_2N(CH_2CH_2CH_2NH_2)_2$

Examples 30 to 42

Testing for Activity

The products of various previous Examples were examined for cold flow improver activity.

The test designated CFPP was carried out in accordance with the procedure described in "Journal of the Institute of Petroleum", 52 (1966), 173.

The fuels used are set out in Table 3.

TABLE 3

| Fuel No. | Cloud Point ° C. | % wax * | Density | CFPP ° C. |
|---|---|---|---|---|
| 1 | +1 | 3.7 | 0.833 | −6 |
| 2 | +1 | 4.2 | 0.8565 | −1 |
| 3 | −1 | 4.8 | 0.8464 | −2 |
| 4 | −5 | 2.9 | 0.8527 | −6 |
| 5 | −3 | 4.0 | 0.8445 | −6 |

*Wax percentage at 10° C. below cloud point, as measured by DSC.

The compounds of the invention were used in conjunction with or compared with an ethylene-vinyl acetate copolymer, 36.5% by weight vinyl acetate, Mn 2500 and linearity of 3 to 4 $CH_3/100CH_2$ (Additive A), the adduct of phthalic anhydride and di-hydrogenated tallow amine (Additive B), both materials being regarded as arrestors, polyethylene glycol (mol wt. about 400) behenate (Additive C) and an ethylene-vinyl acetate copolymer, 13.5 wt % vinyl acetate, Mn 5000 and linearity of $6CH_3/100CH_2$ (Additive D). The proportions given below are parts of the active ingredient of the relevant additive per million parts of fuel treated.

In Examples 30 to 38, Fuel 1 was used.

The results are shown in Tables 4 to 9 below.

EXAMPLE 30 - TABLE 4

| Proportion of Additive, ppm | | Proportion of Compound of | |
|---|---|---|---|
| A | B | Example 1, ppm | CFPP, ° C. |
| 270 | | 30 | −8 |
| | 270 | 30 | −6 |
| 360 | | 40 | −13 |
| | 360 | 40 | −9 |
| 540 | | 60 | −18 |
| | 540 | 60 | −10 |

EXAMPLE 31 - TABLE 5

| Proportion of Additive, ppm | | Proportion of Compound of | |
|---|---|---|---|
| A | B | Example 3, ppm | CFPP, ° C. |
| 270 | | 30 | −8 |
| | 270 | 30 | −6 |
| 360 | | 40 | −10 |
| | 360 | 40 | −10 |
| 540 | | 60 | −17 |
| | 540 | 60 | −10 |

EXAMPLE 32 - TABLE 6

| Proportion of Additive, ppm | | Proportion of Compound of | |
|---|---|---|---|
| A | B | Example 5, ppm | CFPP, ° C. |
| 270 | | 30 | −11 |
| | 270 | 30 | −6 |
| 360 | | 40 | −10 |
| | 360 | 40 | −4 |

EXAMPLE 32 - TABLE 6-continued

| Proportion of Additive, ppm | | Proportion of Compound of | |
|---|---|---|---|
| A | B | Example 5, ppm | CFPP, ° C. |
| 540 | | 60 | −15* |
| | 540 | 60 | −7* |

*The compound of Example 5 was precipitating at this concentration.

EXAMPLE 33 - TABLE 7

| Proportion of Additive, ppm | | Proportion of Compound of | |
|---|---|---|---|
| A | B | Example 6, ppm | CFPP, ° C. |
| 270 | | 30 | −9 |
| | 270 | 30 | −8 |
| 360 | | 40 | −12 |
| | 360 | 40 | −10 |
| 540 | | 60 | −15 |
| | 540 | 60 | −11 |

EXAMPLE 34 - TABLE 8

| Proportion of Additive, ppm | | Proportion of Compound of | |
|---|---|---|---|
| A | B | Example 7, ppm | CFPP, ° C. |
| 270 | | 30 | −13 |
| | 270 | 30 | −7 |
| 360 | | 40 | −14 |
| | 360 | 40 | −8 |
| 540 | | 60 | −17 |
| | 540 | 60 | −9 |

EXAMPLE 35 - TABLE 9

| Proportion of Additive, ppm | | Proportion of Compound of | |
|---|---|---|---|
| A | B | Example 8, ppm | CFPP, ° C. |
| 270 | | 30 | −10 |
| | 270 | 30 | −7 |
| 360 | | 40 | −11 |
| | 360 | 40 | −8 |
| 540 | | 60 | −12 |
| | 540 | 60 | −6 |

Examples 36 to 38

The compounds were used in conjunction with Additive A, and compared with the effect of a combination of Additives A and C. The effects on CFPP are shown in Table 10 below:

TABLE 10

| Proportion of | Proportion of | CFPP, ° C. with Test Additive | | | | |
|---|---|---|---|---|---|---|
| Additive A, ppm | Test Additive | None | Ex. 6 | Ex. 7 | Ex. 8 | C |
| 270 | 30 | — | −8 | −7 | −7 | −5 |
| 360 | 40 | −3 | −10 | −8 | −8 | −8 |

TABLE 10-continued

| Proportion of Additive A, ppm | Proportion of Test Additive | CFPP, ° C. with Test Additive None | Ex. 6 | Ex. 7 | Ex. 8 | C |
|---|---|---|---|---|---|---|
| 540 | 60 | −3 | −11 | −9 | −6* | −9 |

*The compound of Example 8 was precipating at this concentration.

The results show that the cold flow activities of the compounds of Examples 6 and 7 compare favourably with that of the commercially available polyethylene glycol ester.

Example 39

The products of various preparative Examples were used at various treat rates in Fuels Nos. 2, 3 and 4, in combination with Additive A at a ratio of compound:Additive A of 1:4 and in combination with Additive B at a ratio of compound:Additive B of 1:3. The resulting CFPP's are shown in Table 11 below, together with results showing the effect of no additive (Base Fuel), Additive A or B alone, and a combination of Additive A or B with Additive C.

TABLE 11

| Product of Example No. | Fuel & Co-Additive Total Treat Rate, ppm | 2,A 800 | 3,A 600 | 4,A 400 | 2,B 800 | 3,B 800 | 4,B 400 |
|---|---|---|---|---|---|---|---|
| | | CFPP, ° C. | | | | | |
| 2 | | −17 | −13 | −19 | −4 | −10 | −19 |
| 4 | | −16 | −10 | — | −1 | −4 | −17 |
| 9 | | −14 | −9 | −19 | −3 | −10 | −18 |
| 10 | | −13 | −11 | −20 | −5 | −10 | −17 |
| 15 | | −9 | −10 | −19 | −4 | −10 | −18 |
| 16 | | −11 | −9 | −18 | −5 | −11 | −17 |
| 17 | | −12 | −16 | −20 | −5 | −10 | −18 |
| NONE | | −1 | −2 | −7 | −1 | −2 | −7 |
| A or B | | 1 | 0 | −12 | 1 | 0 | −12 |
| A/C or B/C | | −12 | −9 | −18 | −5 | −10 | −18 |

The results show the CFPP-enhancing effects of the compounds of the invention, especially those in which $R^6$ contains at least 18 carbon atoms.

Example 40

In this example, various nucleator compounds of the invention were used in conjunction with one of two arrestors, Additive A, or an ethylene-vinyl octanoate copolymer, Additive E, obtained by transesterification of Additive A with n-octanoic acid. The efficacy of the compounds of the invention in lowering the CFPP of Fuel 5 was compared with that of Additive D. In each case, the arrestors and nucleators were used in a 9:1 ratio by weight. The results are shown in Table 12.

TABLE 12

| Arrestor | Nucleator - Product of Ex. No. (or Additive) | Treat Rate, ppm 225:25 | 270:30 | 360:40 | 450:50 |
|---|---|---|---|---|---|
| | | CFPP, ° C. | | | |
| A | D | | −8 | −9 | −11 |
| A | 18 | | −11 | −12 | −12 |
| A | 19 | | −9 | −9 | −12 |
| E | D | | −13 | −16 | −18 |
| E | 20 | | −18 | −18 | −19 |

TABLE 12-continued

| Arrestor | Nucleator - Product of Ex. No. (or Additive) | Treat Rate, ppm 225:25 | 270:30 | 360:40 | 450:50 |
|---|---|---|---|---|---|
| | | CFPP, ° C. | | | |
| E | 21 | | −15 | −18 | −18 |
| E | 22 | −18 | −19 | | |
| E | 23 | −16 | −19 | | |
| E | 24 | −16 | −19 | | |
| E | 25 | | −16 | | |
| E | 26 | −16 | | | |
| E | 27 | −18 | −20 | −21 | |
| E | 28 | −18 | −19 | | |

Example 41

In this Example, two compounds of the invention are used as the sole CFPP depressant in Fuel 4 (CFPP −6° C.), at various treat rates, the results being shown in Table 13.

TABLE 13

| Compound of Ex. | Treat Rate, ppm 200 | 400 | 600 |
|---|---|---|---|
| | CFPP, ° C. | | |
| 2 | −9 | −11 | −12 |
| 4 | −10 | −10 | −13 |

Example 42

In this Example, two compounds of the invention are used alone and in combination with Additive B in Fuel 3 (CFPP −2° C.) at various treat rates, the result being shown in Table 14. The table shows total treat rates in each case, Additive B and the compounds of the invention being used in combination at a weight ratio of 3:1.

TABLE 14

| Additive | Treat Rate, ppm 400 | 600 | 800 |
|---|---|---|---|
| | CFPP, ° C. | | |
| B alone | 2 | 0 | −3 |
| Ex. 15 alone | −1 | −4 | −1 |
| B/15,3:1 ratio | −2 | −4 | −10 |
| Ex. 16 alone | −2 | −2 | 0 |
| B/16,3:1 ratio | −3 | −6 | −11 |

What is claimed is:

1. A method of improving the cold flow characteristics of an oil susceptible to wax formation at low temperatures, comprising adding to the oil a compound of the formula $$(R^1R^2N)_m—A—(NR^1R^3)_n \qquad Ia$$

or $$BNR^1{}_2 \qquad Ib$$

wherein

A represents an (m+n) valent hydrocarbon radical and B represents a monovalent hydrocarbon radical optionally interrupted by at least one heteroatom selected from oxygen and nitrogen, each $R^1$ independently represents $$—CHR^4\ (CHR^5)_pCOOR^6 \qquad II$$

$R^2$ and $R^3$ each independently represent $R^1$, H, or an alkyl group containing from 1 to 8 carbon atoms, $R^4$ and $R^5$ each independently represent H or an alkyl group containing from 1 to 8 carbon atoms, $R^6$ represents a hydrocarbyl group containing from 8 to 32 carbon atoms optionally interrupted by at least one hetero atom selected from oxygen and nitrogen, m and n each represent an integer up to 12 or zero provided that the total number or $R^1$ groups is at least 2, and p represents zero or an integer within the range of from 1 to 4.

2. The method as claimed in claim 1, wherein A or B represents a radical containing from 1 to 200 carbon atoms.

3. The method as claimed in claim 2, wherein A or B contains from 2 to 65 carbon atoms.

4. The method as claimed in claim 1, wherein A or B represents a saturated aliphatic radical.

5. The method as claimed in claim 1, wherein A or B represents a saturated aliphatic radical interrupted by oxygen atoms.

6. The method as claimed in claim 3, wherein A represents a polyoxyalkylene radical.

7. The method as claimed in claim 3, wherein A represents a radical of the formula $$-[(CH(CH_3)CH_2O]_a-[CH_2CH_2O]_b-[CH_2CH(CH_3)O]_c-CH_2CH(CH_3)-$$

where a+c is within the range of 2 to 4 and b is within the range of 5 to 100.

8. The method as claimed in claim 1, wherein p represents 1 and both $R^4$ and $R^5$ represent hydrogen.

9. The method as claimed in claim 1, wherein $R^6$ represents a hydrocarbyl group having from 8 to 32 carbon atoms.

10. The method as claimed in claim 1, wherein $R^6$ represents a hydrocarbyl group having at least 18 carbon atoms.

11. The method as claimed in claim 1, wherein $R^6$ represents a saturated aliphatic radical.

12. The method as claimed in claim 1, wherein A represents a polyoxyalkylene group, $R^2$, $R^3$, $R^4$ and $R^5$ represent hydrogen, m, n, and p represent 1.

13. The method as claimed in claim 1, wherein A represents a polyoxyalkylene group, m, n and p represent 1, $R^4$ and $R^5$ represent hydrogen, $R^2$ and $R^3$ represent $R^1$.

14. The method as claimed in claim 10, wherein the polyoxyalkylene radical is of the formula $$-[CH(CH_3)CH_2O]_a-[CH_2CH_2O]_b-[CH_2CH(CH_3)O]_c-CH_2CH(CH_3)-$$

where a+c is within the range of 2 to 4 and b is within the range of 5 to 100.

15. A composition comprising an oil and a compound of the formula $$(R^1R^2N)_m-A-(NR^1R^3)_n \qquad Ic$$

wherein

A represents an (m+n) valent hydrocarbon radical optionally interrupted by at least one heteroatom selected from oxygen and nitrogen, each $R^1$ independently represents $$-CHR^4(CHR^5)_pCOOR^6 \qquad II$$

$R^2$ and $R^3$ each independently represent $R^1$, H or an alkyl group containing from 1 to 8 carbon atoms, $R^4$ and $R^5$ each independently represent H or an alkyl group containing from 1 to 8 carbon atoms, $R^6$ represents a hydrocarbyl group containing from 8 to 32 carbon atoms optionally interrupted by at least one hetero atom selected from oxygen and nitrogen, m and n each represent an integer up to 12 or zero, and p represents an integer within the range of from I to 4, provided that the total number of $R^1$ groups is at least 3 when p represents 1.

16. A composition as claimed in claim 13 wherein A represents a polyoxyalkylene group, $R^2$, $R^3$, $R^4$ and $R^5$ represent hydrogen, m, n and p represent 1, and $R^6$ represents a mixture of $C_{20}$ and $C_{22}$ alkyl groups.

17. The composition as claimed in claim 15, wherein the oil contains the compound in a proportion of from 0.0005 to 1% based on the weight of oil.

18. An additive concentrate comprising a compound of the formula $$(R^1R^2N)_m-A-(NR^1R^1)_n \qquad Ic$$

wherein

A represents an (m+n) valent hydrocarbon radical optionally interrupted by at least one heteroatom selected from oxygen and nitrogen, each $R^1$ independently represents $$-CHR^4(CHR^5)_pCOOR^6 \qquad II$$

$R^2$ and $R^3$ each independently represent $R^1$, H or an alkyl group containing from 1 to 8 carbon atoms, $R^4$ and $R^5$ each independently represent H or an alkyl group containing from 1 to 8 carbon atoms, $R^6$ represents a hydrocarbyl group containing from 8 to 32 carbon atoms optionally interrupted by at least one hetero atom selected from oxygen and nitrogen, m and n each represent an integer up to 12 or zero, and p represents an integer within the range of from 1 to 4, provided that the total number of $R^1$ groups is at least 3 when p represents 1 and an oil or a solvent miscible with oil.

19. A concentrate composition as claimed in claim 18, which contains from 3 to 75% by weight of the compound.

20. A composition as claimed in claim 15 additionally comprising an ethylene-unsaturated ester copolymer.

21. A composition as claimed in claim 20, wherein the said copolymer is an ethylene-vinyl acetate copolymer.

22. A composition as claimed in claim 20, wherein the copolymer has a proportion of ester units within the range of 7.5 to 35 molar percent and Mn of at most 14000.

23. A composition as claimed in claim 15 which also comprises a comb polymer.

24. A composition as claimed in claim 23, wherein the comb polymer is of the general formula

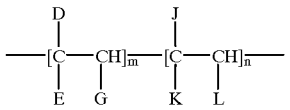

wherein

D=$R^{11}$, $COOR^{11}$, $OCOR^{11}$, $R^{12}COOR^{11}$, or $OR^{11}$,

E=H, $CH_3$, D, or $R^{12}$,

G=H or D

J=H, $R^{12}$, $R^{12}COOR^{11}$, or an aryl or heterocyclic group,

K=H, $COOR^{12}$, $OCOR^{12}$, $OR^{12}$, or COOH,

L=H, $R^{12}$, $COOR^{12}$, $OCOR^{12}$, COOH, or aryl, $R^{11} \geqq C_{10}$ hydrocarbyl, $R^{12} \geqq C_1$ hydrocarbyl or hydrocarbylene,
and m and n represent mole ratios, m being within the range of from 1.0 to 0.4, n being in the range of from 0 to 0.6.

25. A composition as claimed in claim 23, wherein the comb polymer is a copolymer of vinyl acetate and a fumarate ester.

26. A composition as claimed in claim 25, which comprises a mixture of two comb polymers:
(i) a $C_{14}$ fumarate ester-vinyl acetate copolymer and
(ii) a $C_{14}/C_{16}$fumarate ester-vinyl acetate copolymer.

27. A composition as claimed in claim 26, wherein the ratio of comb polymers (i): (ii) is within the range of from 1:1 to 4:1.

28. A composition as claimed in claim 15, which also comprises a polar nitrogen compound.

29. A composition as claimed in claim 28, wherein the polar nitrogen compound is an adduct of phthalic anhydride and di-hydrogenated tallow amine.

30. The composition as claimed in claim 15 wherein the oil is a fuel oil.

31. The composition as claimed in claim 30, wherein the fuel oil has a wax content measured at 10° C. below cloud point of above 2%.

* * * * *

UNITED STATES PATENT AND TRADEMARK OFFICE

CERTIFICATE OF CORRECTION

PATENT NO. : 6,254,651 B1
DATED : July 3, 2001
INVENTOR(S) : B.C. Brooke, R.D. Tack It is certified that error appears in the above-identified patent and that said Letters Patent is hereby corrected as shown below:

Claim 1,
Figure 1c, delete "$(R^1R^2N)_m$-A-$(NR^1R^1)_n$" and insert -- "$(R^1R^2N)_m$-A-$(NR^1R^3)_n$ --.

Signed and Sealed this

Twenty-sixth Day of February, 2002

*Attest:*

*Attesting Officer*

JAMES E. ROGAN
*Director of the United States Patent and Trademark Office*